United States Patent [19]

Marathe

[11] 4,022,273

[45] May 10, 1977

[54] BOTTOM HOLE FLOW CONTROL APPARATUS

[75] Inventor: Anil Marathe, Huntington Beach, Calif.

[73] Assignee: Cook Testing Co., Long Beach, Calif.

[22] Filed: Oct. 10, 1975

[21] Appl. No.: 621,588

[52] U.S. Cl. ..... 166/65 R; 166/129; 166/322

[51] Int. Cl.[2] ..... E21B 43/00; E21B 33/12; E21B 43/12

[58] Field of Search ..... 166/65 R, 120, 129, 166/183, 185

[56] References Cited

UNITED STATES PATENTS

| | | | |
|---|---|---|---|
| 3,156,300 | 11/1964 | Page et al. | 166/224 A |
| 3,313,350 | 4/1967 | Page, Jr. | 166/129 |
| 3,378,079 | 4/1968 | Page, Jr. | 166/129 |

*Primary Examiner*—James A. Leppink

*Attorney, Agent, or Firm*—Lyon & Lyon

[57] ABSTRACT

An apparatus for controlling flow from a producing zone through a tubing string and through a bypass into the annulus between the tubing string and casing, the apparatus including a production flow tube and bypass tube extending through a packer which is set by fluid pressure supplied through the tubing string. A safety valve and sleeve assembly is positioned by wire line after the packer is set, the sleeve including a bypass control valve. The tubing string may carry a pump and electric motor and the bypass may receive encased conductors for the motor. The safety valve sleeve assembly includes fluid pressure responsive means for holding the safety valve in its open position, and a small pressure fluid line extends to the well mouth. Drop in pressure in the fluid line, either by control at the well mouth or by damage to the pressure fluid line, permits a spring to close the safety valve against upward flow of well fluid, and also to close the bypass control valve.

10 Claims, 11 Drawing Figures

BOTTOM HOLE FLOW CONTROL APPARATUS

BACKGROUND

It is customary to provide a safety valve at the lower end of a tubing string, the safety valve being lowered and set by a wire line as well as connected to a small pressure fluid line extending alongside the tubing string to the well mouth. The safety valve is held open by a sleeve subject to fluid pressure supplied through the pressure fluid line. Release of pressure in the pressure fluid line either intentionally by a valve at the well mouth or by damage to the pressure fluid line causes the safety valve to close. Also it is customary to provide a packer between the tubing string and surrounding casing.

If a bottom hole pump and electric motor is required or for other reason a bypass through the packer which will not interfere with operation of the safety valve is required, the standard packer does not provide for a bypass, nor does the standard safety valve assembly provide for control of the packer bypass.

SUMMARY

The present invention is directed to a bottom hold flow control apparatus which is summarized in the following objects:

First, to provide an apparatus which utilizes a novelly arranged packer having a main flow passage and a bypass therethrough, the packer adapted to be set and secured against downward force by fluid pressure supplied through the tubing string and later maintained secured against an upward force by fluid pressure incidental to the pumping of well fluid.

Second, to provide an apparatus, as indicated in the preceeding object, which utilizes a main safety valve assembly including a safety valve held in its open position by means including a sleeve, a piston and a small pressure fluid line extending to the well mouth and upon release is closed by a spring as well as well fluid pressure; the safety valve assembly further including a novelly arranged sleeve type bypass safety valve unit for opening the bypass when the main safety valve is open and closing the bypass when the main safety valve is closed.

Third, to provide an apparatus, as indicated in the other objects, wherein the bypass and its safety valve unit is arranged for use in conjunction with a pump and electric motor, the bypass not only receiving the electric cable, but also permitting upward gas flow into the annulus between the tubing string and the surrounding casing, while assuring the lower end of the tubing string is locked in place.

Fourth, to provide an apparatus, as indicated in the preceeding object, wherein the apparatus may be utilized for other dual flow systems in which the bypass may be used for gas flow in gas lift systems, or to permit back flow of pressure fluid to kill the well, while insuring that the bypass will be closed by its safety valve simultaneously with closure of the main safety valve.

Fifth, to provide an apparatus, as indicated in the other objects wherein the safety valve assembly including the main and bypass safety valve units are removable by a conventional wire line tool, if necessary, for repair or inspection of the valves and the seal rings.

DETAILED DESCRIPTION

Figure 1:
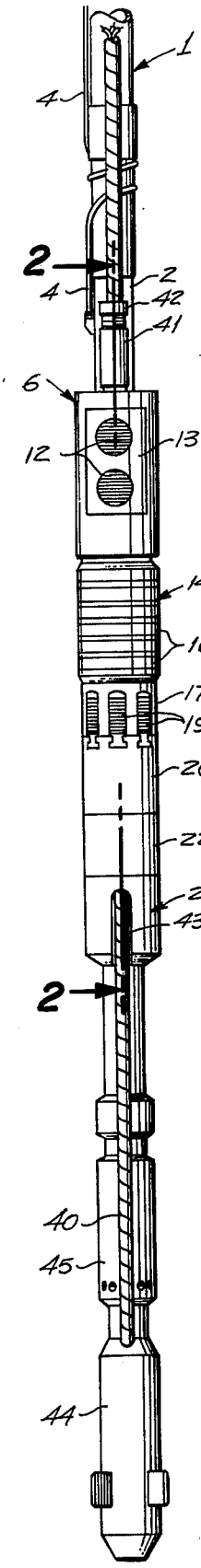
FIG. 1 is a side view of the bottom hole flow control apparatus, shown suspended from a tubing string and connected to a pump and motor.

The bottom hole flow control apparatus is adapted to be supported from a tubing string 1 by means of a tubular fitting 2, having therein a pressure fluid inlet channel 3 connected to a pressure fluid line 4 which extends along side the tubing string to the mouth of the well. The fitting 2 has a second channel 5 provided with radial ports which forms a bypass safety valve outlet.

Figure 6:
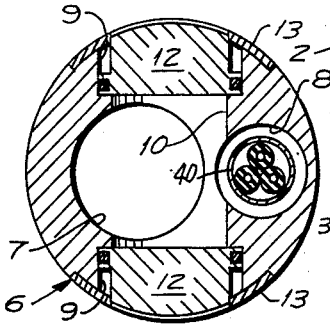
FIG. 6 is a transverse sectional view taken through 6—6 of FIG. 2.
Figure 7:
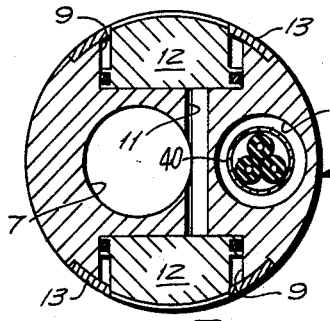
FIG. 7 is a transverse sectional view taken through 7—7 of FIG. 2.

As shown in FIGS. 6 and 7, a cylindrical housing 6 is provided which has an eccentric main bore 7 and bypass bore 8 in parallel relation therewith. The housing is provided with two radially opposed pairs of sockets 9 disposed at right angles to the axis of the bores 7 and 8. The upper pair of sockets is provided with a connecting passage 10 which intersects both bores 7 and 8, the lower pair of sockets are joined by a connecting passage 11 which intersects only the main bore 7.

The sockets 9 reveive anchor pistons 12 having serrations for engagement for a surrounding casing and are provided with appropriate seal rings. Retainer plates 13 limit outward movement of the anchor pistons.

Joined to the lower end of the housing 6 is a packer 14 having a tubular sleeve 15 on which are slidably mounted a plurality of packing rings 16. Below the packing rings is a slip collar 17 having tapered guideways 18 for a set of slips 19, having appropriate serrations. The slips are held by a slip retainer ring 20 which, when moved upwardly, relative to the slip collar 17, forces the slip 19 into engagement with surrounding casing 21.

Screwthreaded to the lower end of the slip retainer ring 20 is a cylinder 22 having a counterbore 23 which receives an annular piston 24, the piston extends upwardly from a mounting sleeve 25 having an eccentrically disposed bore 26 which aligns with the main bore 7.

Extending through the bore 26, through the packer and screwthread into the lower end of the main bore 7 is a main flow tube 27 having a shoulder 28 which is engaged by the portion of the mounting sleeve 25 surrounding the eccentric bore 26. The lower end of the tubular sleeve 15 engages an upwardly facing shoulder 29 formed in the mounting sleeve 25 above the shoulder 28.

The piston 24 forms with the sleeve 15, an annular inlet passage 30 which is in communication with an axial inlet passage 31 which extends downwardly and intersects the eccentric bore 26, adjacent the shoulder 28. In this region the main flow tube 27 is provided with an external channel 32 connected by radial ports with the interior of the main flow tube 27.

As will be brought out hereinafter, a plug 33 is temporarily positioned below the inlet passage 21 for the purpose of supplying pressure fluid to the pressure chamber 34, between the cylinder 22 and the piston 24.

Figure 2:
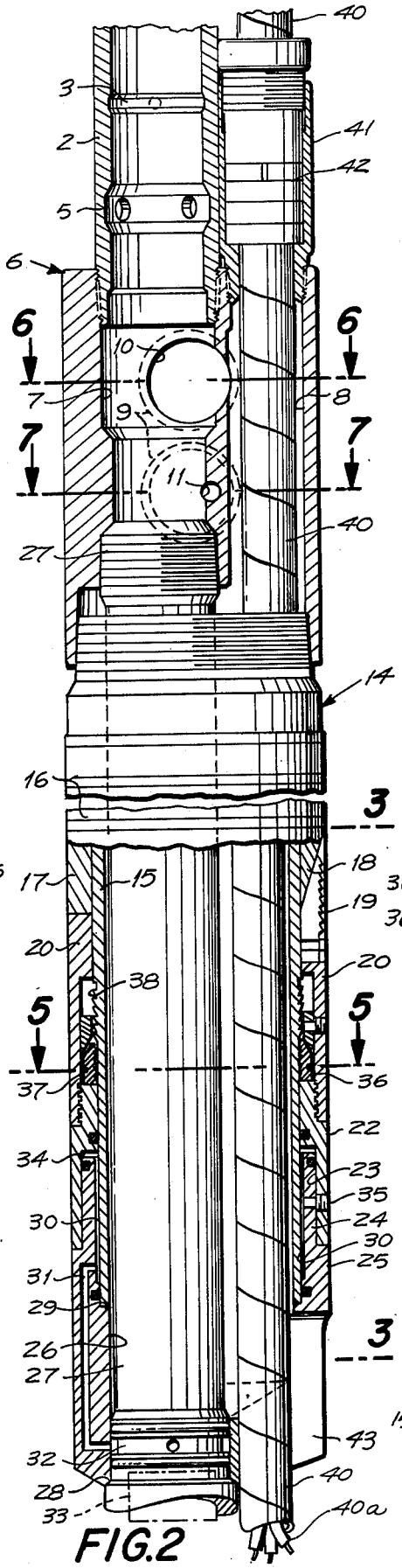
FIG. 2 is an enlarged fragmentary longitudinal sectional view taken through 2—2 of FIG. 1, with portions shown in elevation, the parts being shown in their relative positions assumed when the apparatus is being run into the well.
Figure 5:
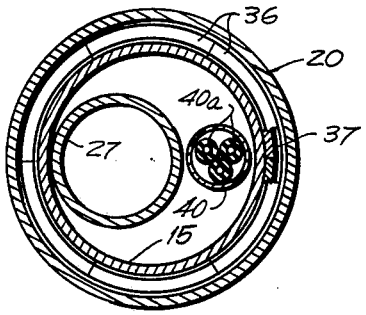
FIG. 5 is a transverse sectional view, taken through 5—5 of FIG. 2.

The cylinder 22 and piston 24 are initially in a closed position, that is the pressure chamber 34 is of minimum size as shown in FIG. 2. The cylinder and piston are initially secured in this position by means of shear pins 35. Initially resting on the upper end of the cylinder 22 within the slip retainer ring 20 is a set of latch segments 36 which are urged radially inward by a surrounding spring wire or elastomeric band 37. The latch segments have radially internal teeth which engage latching teeth 38 provided on the tubular sleeve 15.

Figure 3:
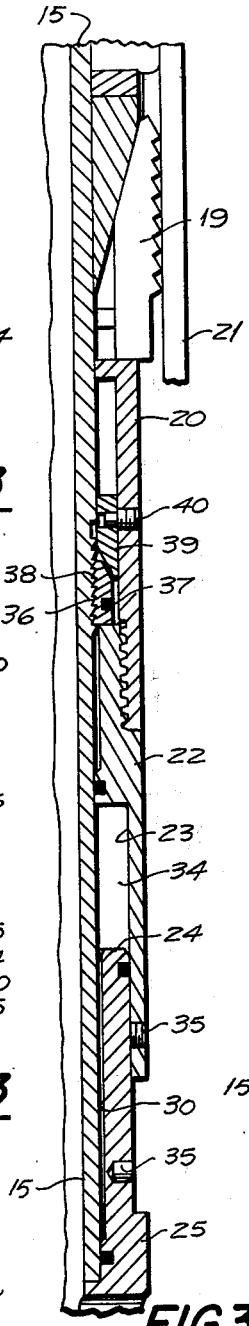
FIG. 3 is a further enlarged fragmentary sectional view taken in the same plane as FIG. 2, in the region between 3—3, showing the parts as they appear upon setting the packer.

In order to lift the cylinder 22 from the piston 24 the plug 33 which forms a part of a conventional wire line tool is held in place below the entrance to the inlet passage 30 whereupon a predetermined pressure is applied through the tubing string to shear the pins 35 and permit the cylinder 22 to be forced upward as shown in FIG. 3, causing the slip retainer ring 20 to force the slips 19 upwardly and outwardly along the tapered guideways 18 until the slips engage the surrounding casing 21. As this occurs the latch segments 26 move upward with respect to the latching teeth 38 carried by the tubular sleeve 15, as shown in FIG. 3.

Figure 4:
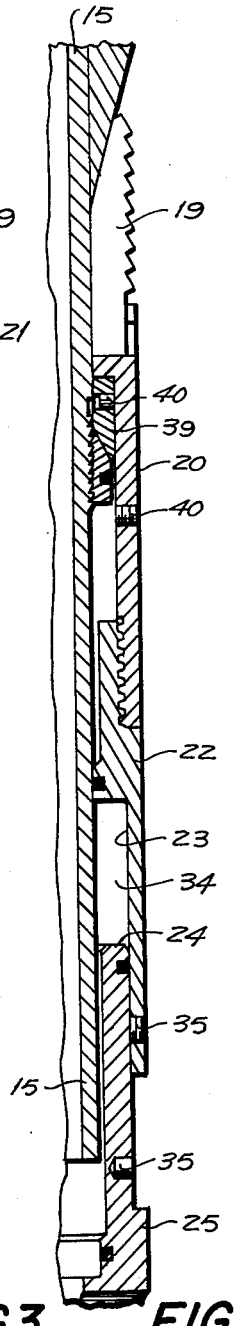
FIG. 4 is a fragmentary sectional view, corresponding to FIG. 3, but showing the parts as they appear after unseating the packer.

When it is desired to release the packer, the tubing string is mechanically jarred in an upward direction causing the segments 36 to engage a stop ring 39, initially held by a shear pin 40 in position with the slip retainer ring 20, upon shearing of the pins 40 the guideways 18 move upward with respect to the retainer ring causing the slips to clear the surrounding casings as shown in FIG. 4.

The bypass bore 8 is primarily intended to receive an electrical conduit 40 containing conductors 40a. The upper end of the bypass bore 8 receives a packing sleeve 41 and packing gland 42 for sealing engagement with the emerging electrical conduit 40, as shown in FIG. 2. The conduit 40 emerges from the lower mounting sleeve 25 through a slot 43. The main flow tube 27 is joined directly or through intermediate tubing to a pump 44 and electric motor 45 to which the conduit 40 is attached.

Figure 9:
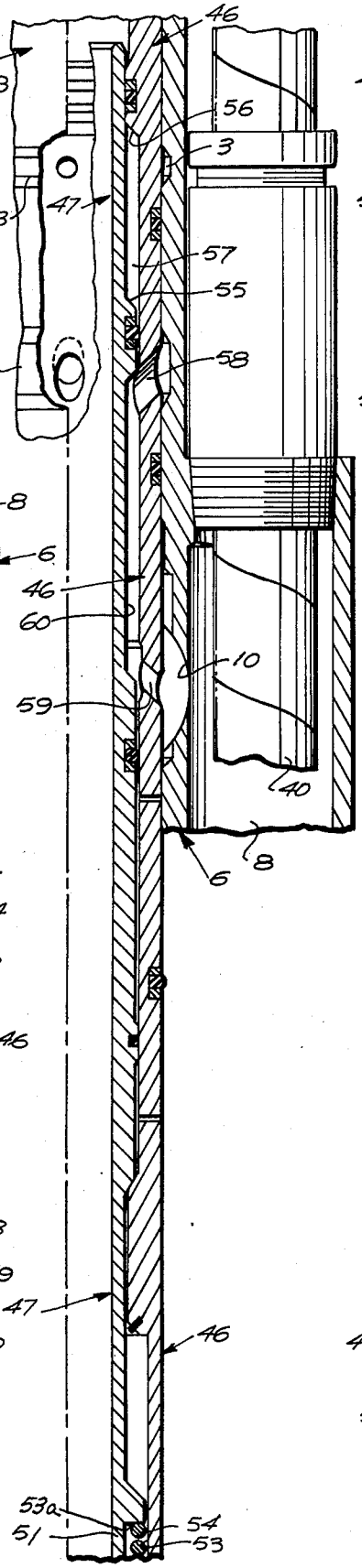
FIG. 9 is a fragmentary half sectional view of the portion continuing from FIG. 8, the parts being shown when the main and bypass safety valves are in their open position and the assembly is secured in operating relation with the packer.
Figure 10:
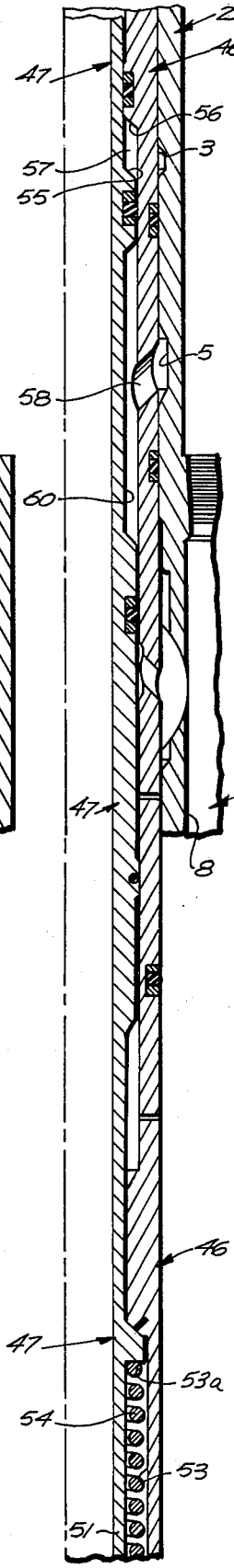
FIG. 10 is a fragmentary sectional view corresponding to FIG. 9, showing the bypass safety valve in its closed position.
Figure 11:
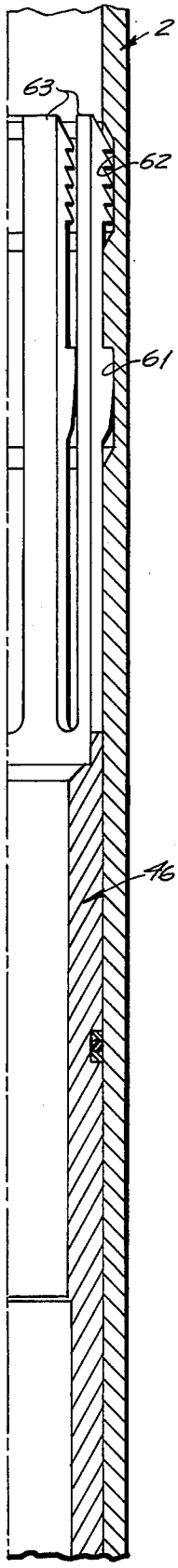
FIG. 11 is a fragmentary half sectional view continuing from the top end of FIG. 10.

After the packer has been lowered to position and set, as indicated in FIG. 3, a safety valve assembly is lowered by a wire line into main bore 7 and main flow tube 27, the construction of the safety valve assembly is illustrated particularly in FIGS. 9, 10 and 11. This assembly includes an outer sleeve sub-assembly 46 and an inner sleeve sub-assembly 47, each of which comprises a series of tubular segments joined together by conventional screwthreads, however, to simplify by illustration the screwthreads are omitted.

Figure 8:
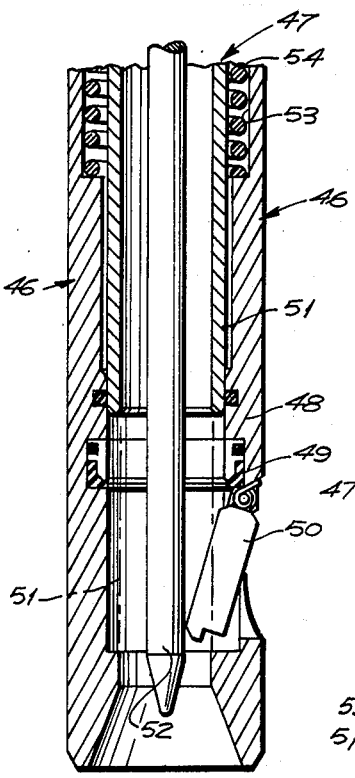
FIG. 8 is a fragmentary sectional view showing the bottom portion of a removable safety valve assembly, the main safety valve being held in an open position as the safety valve assembly is being lowered in the tubing string, prior to being secured in place.

The lower end of the outer sleeve sub-assembly forms a tubular valve housing 48 having a downwardly facing horizontally disposed valve seat 49. Pivoted at one side of the housing below the valve seat is a main safety valve 50, illustrated as being of the flapper type, the inner sleeve sub-assembly includes as its lower end a valve retaining sleeve 51 which in FIG. 8 is shown in its raised position clearing the valve. The sleeve is movable downwardly therefrom, as indicated by broken lines, to a position holding the safety valve 50 in its open position. Also illustrated in FIG. 8 is a central bar 52 which serves to hold the valve in a nearly full open position during the lowering of the safety valve assembly. When once the safety valve assembly is secured, as will be brought out hereinafter, the bar 52 is removed.

The outer sleeve sub-assembly is provided above the valve housing with a spring chamber 53 which receives a spring 54. The spring engages a shoulder 53a forming the upper end of the chamber 53, and urges the inner sleeve sub-assembly 47 in an upward direction with respect to the outer sleeve sub-assembly 46, that is the spring urges the inner sleeve sub-assembly 47 from the position shown in FIG. 9 to the position shown in FIG. 10.

At the upper end of the inner sleeve sub-assembly 47 an annular piston shoulder 55 opposed by an annular cylinder shoulder 56 within the outer sleeve sub-assembly 46. Between the shoulder 55 and 56 there is formed an annular pressure chamber 57 which is in communication with the pressure fluid inlet channel 3, pressure applied in this chamber 57 opposes the force of the spring 54.

Formed in the outer sleeve sub-assembly 46 is an upper set of bypass ports 58 which register with the bypass safety valve outlet 5. A lower set of bypass ports 59 register with the connecting passage 10 extending between the upper set of anchor pistons 12. When the inner sleeve sub-assembly 47 is in its lower position, shown in FIG. 9, an annular connecting chamber 60 formed in the inner sleeve sub-assembly bridges between the ports 58 and 59; that is, when the main safety valve 50 is held in its open position the bypass safety valve formed by the ports 58 and 59 and the connecting chamber 60 is in its open position.

It will be noted that appropriate seal rings are provided where needed as shown in the drawings, however, the seal rings have not been identified by number to simplify the illustration.

Referring to FIG. 11, provided in the upper portion of the fitting 2 is a set of conventional key channel 61 and 62, which serve to receive conventional latch springs 63 extending upwardly from the outer sleeve sub-assembly 46, as shown in FIG. 11. The channels 61 and 62 and latch springs 63 are more fully disclosed in U.S. Pat. No. 3,698,477, which also discloses a wire line mounted tool for running in the safety valve assembly and for removing the assembly.

Operation of the bottom hole flow apparatus is as follows:

The packer assembly, pump, electric motor, electric conduit, pressure fluid line and tubing string are lowered as a unit, the parts being in their relative position as shown in FIG. 1 and 2. When the desired level is reached the packer is set by first lowering a conventional wire line tool carrying a plug 33 indicated in broken outline in FIG. 2. Fluid pressure is then applied through the tubing string to the chamber formed between the cylinder 22 and 24. The force applied is sufficient to shear the pins 35 permitting the cylinder 22 and flip retainer ring 20 to move upward as shown in FIG. 3, until the slips 19 have set the packer. The plug 33 is then removed.

When the safety valve assembly is lowered, the outer and inner sleeve sub-assemblies 46 and 47 are in the position shown in FIGS. 8 and 10, that is the valve retaining sleeve 51 is in its upper position and the bypass safety valve is closed. The main safety valve 50 is held in its open position by the rod or bar 52, the conventional running in tool, not shown, is connected to the upper portion of the outer sleeve sub-assembly 46 by means not shown, until the latch springs 63 engage the channels 61 and 62, as shown in FIG. 11, which properly positions the outer sleeve sub-assembly in the desired relation to the surrounding portions of the main bore. The landing tool is then removed and pressure is supplied through the line 4 to force the inner sleeve sub-assembly 47 downward with respect to the outer sleeve sub-assembly 46 in which position both safety valves occupy an open position.

During operation of the pump, both safety valves remain open. The bypass bore may serve several purposes, it permits the bleeding of gas pressure from below the packer to prevent the gas pressure from forcing the oil level to a point below the pump. It also permits the backflow of fluid between the tubing string and casing, should this be desired.

Also during operation of the pump fluid pressure exists in the bypass bore determined by the head of fluid between the tubing string and casing. This pressure acts on the pistons 12 to restrain the packer against upward movement.

While the apparatus is shown in conjunction with a pump and motor, in some cases the apparatus may be used without the pump and motor as well as the electrical conduit, in which case a plug is placed in the packing sleeve 41 and bypass flow is permitted through the bypass safety valve for pumping or for other purposes.

Should the pressure in the fluid line 4 be reduced either intentionally or by reason of damage to the fluid line 4, both safety valves close simultaneously, that is, upward movement of the sleeve 51 and the pressure chamber 57 permits the main safety valve 50 to close and seals off flow between the ports 58 and 59.

While the main safety valve 50 has been shown as a flapper valve of conventional construction, it should be noted that conventional ball type safety valves may be used.

Having fully described my invention it is to be understood that I am not to be limited to the details herein set forth, but that my invention is of the full scope of the appended claims.

I claim:

1. A tubing string mounted flow control apparatus, comprising:

a. a tubing string suspended packer adapted to be set in a well casing and having a main bore forming a continuation of the tubing string, a bypass bore, an inlet connecting the bypass bore and main bore near their upper ends and communicating with the region below the packer, and an outlet from the main bore communicating with the region above the packer between the tubing string and surrounding well casing;

b. and tubular means removably received in the main bore and forming a flow passage through the main bore, the tubular means including tubular valve elements relatively movable axially to isolate the inlet and outlet from the flow passage, and to effect connection between the inlet and outlet to close or open the bypass bore.

2. A flow control apparatus, as defined in claim 1, wherein:

a. the tubular means also includes a safety valve, carried by one of the valve elements, for closing the main bore flow passage, and the other of the valve elements being arranged to secure the safety valve in its open position permitting flow through the flow passage, or to release the safety valve for closure against forward flow of fluid.

3. A flow control apparatus, as defined in claim 1, wherein;

a. a pump and electric drive motor therefor are disposed below the packer, the pump communicating with the main bore;

b. and an electric power cable, utilizing in part the bypass bore, extends through the packer.

4. A flow control apparatus, as defined in claim 1, wherein:

a. the packer includes hydraulically operated drive means responsive to pressure within the main bore for setting the packer.

5. A well fluid flow control apparatus, comprising:

a. a tubing string supported packer adapted to be set in a well casing, the packer having a main bore connected to the tubing string, a bypass bore and an interconnecting port between the bypass bore and the main bore;

b. a valve assembly including an outer sleeve removably secured in the main bore, an axially movable inner sleeve and a safety valve, the safety valve being carried by the outer sleeve and held by the inner sleeve in an open position, the inner sleeve being movable to release the safety valve for closure; the sleeves forming a shut off valve between the bypass bore and the region above the packer and operable to maintain the shut off valve open when the safety valve is open, and to close the shut off valve when the safety valve is closed.

6. A flow control apparatus as defined in claim 5, wherein:

a. the valve assembly further includes a hydraulic means which, when pressurized, maintains the safety valve and shut off valve in open positions, and spring means is provided to close both of the valves when the hydraulic means is depressurized;

b. and a pressure fluid line extends from the hydraulic means alongside the tubing string.

7. A flow control apparatus, as defined in claim 5, wherein:

a. a pump and electric drive motor therefor are disposed below the packer, the pump communicating with the main bore;

b. an electric cable is loosely received in the bypass bore;

c. a packing gland seals the cable with respect to the bypass bore;

d. and the shut off valve bypasses the packing gland.

8. A flow control apparatus, as defined in claim 5, wherein:

a. a first set of slips secure the packer against downward movement in the well casing;

b. a second set of slips secure the packer against upward movement in the well casing;

c. and piston means for the second set of slips subject to the pressure of fluid in the bypass bore.

9. A well fluid control apparatus, as defined in claim 5, wherein:

a. the main bore and bypass bore are disposed side-by-side and the interconnecting port is disposed between the upper end portions of the main and bypass bores.

10. A well fluid control apparatus, as defined in claim 5, wherein:

a. a pressure fluid tube extends alongside the tubing string;

b. the inner and outer sleeves define a pressure chamber therebetween, the pressure chamber communicating with the pressure fluid tube and operable, when pressurized, to cause the inner sleeve to maintain the safety valve and shut off valve in their open position.

* * * * *